US005727122A

United States Patent [19]

Hosoda et al.

[11] Patent Number: 5,727,122

[45] Date of Patent: Mar. 10, 1998

[54] CODE EXCITATION LINEAR PREDICTIVE (CELP) ENCODER AND DECODER AND CODE EXCITATION LINEAR PREDICTIVE CODING METHOD

[75] Inventors: Kenichiro Hosoda; Hiromi Aoyagi; Hiroshi Katsuragawa; Yoshihiro Ariyama, all of Tokyo, Japan

[73] Assignee: Oki Electric Industry Co., Ltd., Tokyo, Japan

[21] Appl. No.: 379,653

[22] PCT Filed: Jun. 10, 1993

[86] PCT No.: PCT/JP93/00776

§ 371 Date: Feb. 9, 1995

§ 102(e) Date: Feb. 9, 1995

[87] PCT Pub. No.: WO94/29965

PCT Pub. Date: Dec. 22, 1994

[51] Int. Cl.[6] ..... G10L 3/02

[52] U.S. Cl. ..... 395/2.32; 395/2.31; 395/2.25; 395/2.26; 395/2.27; 395/2.75

[58] Field of Search ..... 395/2.32, 2.31, 395/2.25, 2.26, 2.27, 2.75

[56] References Cited

U.S. PATENT DOCUMENTS

| | | | |
|---|---|---|---|
| 5,142,584 | 8/1992 | Ozawa | 395/2.32 |
| 5,293,449 | 3/1994 | Tzeng | 395/2.32 |
| 5,371,853 | 12/1994 | Kao et al. | 395/2.32 |

FOREIGN PATENT DOCUMENTS

| | | | |
|---|---|---|---|
| 0 405 548 A2 | 6/1990 | European Pat. Off. | 395/2.32 |
| 0 462 559 A2 | 6/1991 | European Pat. Off. | 395/2.32 |
| 0 492 459 A2 | 7/1992 | European Pat. Off. . | |
| 3-33900 | 6/1989 | Japan . | |
| 3-171828 | 7/1991 | Japan . | |
| 4-51100 | 2/1992 | Japan . | |
| 4-51199 | 2/1992 | Japan . | |
| 5-165497 | 2/1993 | Japan . | |
| 5-173596 | 7/1993 | Japan . | |
| WO 91/01545 | 2/1991 | WIPO . | |

OTHER PUBLICATIONS

Proc. ICASSP, pp. 65–68, 1989, "Speech Coding With Time–Varying Bit Allocation To Excitation and LPC Parameters", N. S. Jayant, et al.

Proc. ICASSP, pp. 1681–1684, 1986, "High–Quality At Low Bit Rates: Multi–Pulse and Stochastically Excited Linear Predictive Coders", B. S. Atal.

Sekine et al., "A CELP Coder Using Fully–Searched Pulse Excitation," All Hitachi, Ltd., SA–5–3, 1993 Convention of Electronic Information Communication Society.

Gerson et al., "Vector Sum Excited Linear Prediction (VSELP) Speech Coding at 8 KBPS" Proceedings ICASSP 90 IEEE Signal Processing Society Apr. 3–6, 1990 pp. 461–464.

*Primary Examiner*—Allen R. MacDonald
*Assistant Examiner*—Robert Louis Sax
*Attorney, Agent, or Firm*—Spencer & Frank

[57] ABSTRACT

There is provided a code excitation linear predictive (CELP) coding or decoding apparatus in which a code vector, which is transmitted by a codebook such as a stochastic codebook, is converted adaptively in accordance with vocal tract analysis information (LPC) so that a high quality reproduction speech is obtained at a low coding rate. Further, in order to obtain a similar effect, a pulse-like excitation codebook formed of an isolated impulse is provided in addition to the adaptive excitation codebook and stochastic excitation codebook so that either the stochastic excitation codebook or the pulse-like excitation codebook is selectively used to provide a vocal tract parameter as a linear spectrum pair parameter.

22 Claims, 5 Drawing Sheets

CODE EXCITATION LINEAR PREDICTIVE (CELP) ENCODER AND DECODER AND CODE EXCITATION LINEAR PREDICTIVE CODING METHOD

TECHNICAL FIELD OF THE INVENTION

This invention relates to an encoder and a decoder based on the code excitation linear predictive coding (CELP) system.

BACKGROUND OF THE INVENTION

Conventionally, as a highly efficient coding system for a speech signal including an audible signal in the field of digital transportable communication systems, code excitation linear predictive coding and a modification, thereof have been used. The modification is a vector sum excitation linear predictive coding system (VSELP). The coding apparatus which uses the code excitation linear predictive coding (CELP) is disclosed in, for example, N. S. Jayant and J. H. Chen, "Speech Coding with Time-varying Bit Allocation to Excitation and LPC Parameters", Proc. ICASSP, pp 65–68, 1989.

A fundamental construction of a coding system relative to the speech signal obtains vocal tract parameters representing vocal tract properties and excitation source parameters representing excitation source information. In a recent CELP system, an excited signal as an excitation source information is encoded by means of both adaptive excitation code vectors, which contribute to a stochastically stronger periodic excitation signal, and stochastic excitation code vectors which contribute to a stochastic less periodic random excitation signal. Then the coded excitation signals are stored in a codebook, and optimum adaptive excitation code vectors and stochastic excitation code vectors are located in each codebook so that a weighted error power sum between an input speech vector and a synthetic speech vector becomes minimum. Then, whatever it is of a forward-type coding system which obtains vocal tract parameters from an input speech vector or of a backward-type coding system which obtains vocal tract parameters from synthetic speech vectors, at least the excitation source parameters, that is, adaptive excitation code and stochastic excitation code information are transmitted.

By utilizing the code excitation linear predictive (CELP) system as described above, it is known that high quality regenerated speech signals are obtained at a coding rate of 6 kbit/s to 8 kbit/s.

However, some communication systems require lower coding rate, for example 4 kbit/s or less. In such a lower coding rate, regardless of whatever the forward type which transmits both vocal tract parameters and excitation source parameters or the backward type which transmits excitation source parameters is used, the number of coded bits which are assigned to the excitation source parameters is smaller and the number of adaptive excitation code vectors stored in the adaptive excitation codebook and the number of stochastic excitation code vectors stored in the stochastic excited codebook become smaller. Consequently, the quality of the regenerated speech signal inevitably degrades at the lower coding rate as described above.

Besides, the adaptive excited codebook is adaptively renewed by synthetic code vectors of the optimum adaptive excitation code vectors and stochastic excitation code vectors and, accordingly, it can be determined that the adaptive excitation code vectors are formed on the basis of the stochastic excitation code vectors. Therefore, the current CELP coding has a poor tracking capability for a voice signal having a nature of strong periodicity. Consequently, the generated speech signal lacks clearness.

SUMMARY OF THE INVENTION

The present invention is based upon the foregoing problems and an object of the present invention is to provide a code excitation linear predictive coding encoder and decoder which can provide a high quality regenerated speech signal even when pulse-like noise components are contained in the input speech vectors.

Another object of the present invention is to provide a code excitation linear predictive coding encoder and decoder which can provide a high-quality regenerated speech signal even when a lower coding rate is employed.

According to the present invention, there is provided a code excitation linear predictive coding apparatus which uses, as a speech excitation source information, excitation signals in the form of an excitation codebook, wherein the apparatus is provided with a code vector conversion circuit which converts the frequency characteristics of fixed code vector such as stochastic excitation code vector transmitted from the excitation codebook into the predetermined frequency characteristics at the time of output of the excitation code vectors. A primary reason for providing the code vector conversion circuit is set forth below. Conventionally, the frequency characteristic of an excitation signal is modelled as "theoretically white" and yet it actually is not "white" but is recognized by examinations to have a characteristic which is close to the frequency characteristic of input speech vectors. Therefore, the closer the fixed code vector frequency characteristic is set to the frequency characteristics of the input speech vectors, the higher the quality of the synthetic speech vector obtained and, moreover, the effective frequency component of the excitation code vectors becomes much larger than the quantization error vectors so that a masking effect of the quantization error vectors can be obtained. As an information representing frequency characteristic of the code conversion circuit, parameters of LPC (linear predictive coefficient) and optimum adaptive excitation code information which means pitch predictive information (which includes VQ gains) are used. Thus, the code vector conversion circuit controls the frequency characteristics of the stochastic excitation code vectors and so forth, in accordance with this information.

Further, in the present invention, there is provided a code excitation linear predictive decoding apparatus which has a code vector conversion circuit which forces the fixed code vector frequency characteristics close to the input speech vector frequency characteristic in accordance with the respective code excitation linear predictive coding system.

In the code vector converter circuit, an impulse response is determined by the following formula (1) as a filter transfer function H(Z) according to the vocal tract parameters, $$H(Z)=(1-\Sigma A^{j}ajZ^{-j})/(1-\Sigma B^{j}aj^{-j}) \quad (1)$$

or as an impulse response determined by the following formula (2) in accordance with an excited pitch lag, $$H(z)=1/(1-\epsilon Z^{-L}) \quad (2)$$

or as an impulse response which is a cascade-connected filter represented by formulas (1) and (2) used to provide a convolution treatment to the stochastic excitation code vectors. Thereafter adaptive excitations code vectors are added to produce excitation code vectors. Here, aj(j=1 to p) represents a parameter of LPC and p represents the order of LPC analysis. A, B and $\epsilon$ are constants which are determined in the range of $0<A<1$, $0<B<1$ and $0<\epsilon\leqq 1$, respectively, and L represents a pitch lag.

Further, the present invention provides a code excitation linear predictive coding or decoding apparatus which is provided, as an excitation codebook, with an adaptive excitation codebook and stochastic excitation codebook, in which a pulse-like excitation codebook storing a pulse-like excitation code vector which consists of an isolated impulse in addition to the adaptive excitation codebook and stochastic excitation codebook is provided so that the current CELP coding has good tracking capability for a speech signal having strong periodicity. Thus, a clear regenerated speech signal can be obtained.

Further, in the code excited linear predictive coding apparatus, excitation code vectors from the stochastic excitation codebook or pulse-like excitation codebook are selectively used, and this selected information is transmitted to the code excitation linear predictive decoder apparatus. In this code excitation linear predictive decoder apparatus, the excitation code vectors from the stochastic excitation codebook or pulse-like excitation codebook are selected in accordance with the information transmitted from the code excitation linear predictive coding apparatus.

In addition, in each of the above-described code excitation linear predictive encoders, the output of vocal tract parameters are assigned to be LSP (linear spectral pair) parameters and these linear spectral pair parameters are utilized for speech regeneration in the code excitation linear predictive decoder so that the regeneration speech quality at the lower coding rate can be improved from the viewpoint of vocal tract parameters. The reasons for using LSP parameters as the vocal tract parameters are that the interpolation characteristics relative to the frequency characteristics of the vocal tract are improved, that the LSP parameters provides less distortion to the vocal tract spectral than LPC parameters even when the LSP parameters are coded by a smaller number of code bits, and that effective coding can be obtained by the combination with vector quantization.

DETAILED DESCRIPTION OF THE PREFERRED EMBODIMENTS

Preferred embodiments of the code excitation linear predictive coding apparatus (encoder) and the code excitation linear predictive decoding apparatus (decoder) according to the present invention will be described with reference to the figures attached herewith.

Figure 1:
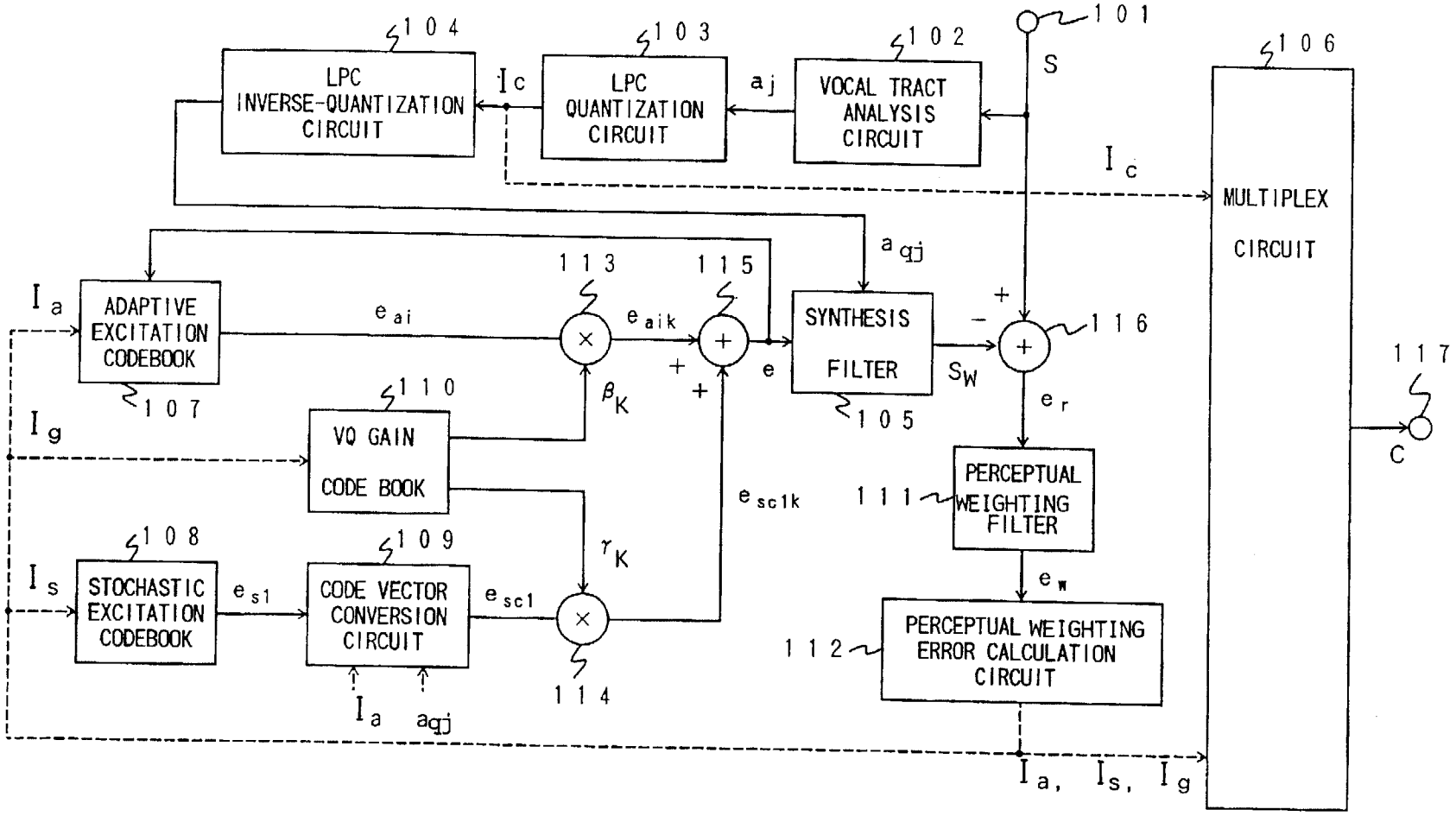
FIG. 1 is a block diagram of a code excitation linear predictive encoder (coding apparatus) according to first and second embodiments of the present invention. The first and second embodiments of the encoder shown in FIG. 1 differ from the prior art only in that a code vector conversion circuit (109) has been added.

Referring to FIG. 1 which shows a code excitation linear predictive encoder (coding apparatus) according to a first embodiment of the present invention, an input speech vector S which has been input in each frame from an input terminal 101 is first transmitted to a vocal tract analysis circuit 102 to obtain a vocal tract parameter $a_j$ (linear predictive coefficient).

An LPC (linear predictive coefficient) quantization circuit 103 quantizes vocal tract predictive parameter $a_j$ and transmits its code $I_c$ (quantized LPC code) to an LPC inverse-quantization circuit 104 and a multiplex circuit 106.

The LPC inverse-quantization circuit 104 serves to convert the LPC code $I_c$ into vocal tract predictive parameter $a_{qj}$ and transmits the same to a synthesis filter 105.

Then, an adaptive excitation code vector $e_{ai}$ (i=1 to n) is outputted from an adaptive excitation codebook 107 and similarly, a stochastic excitation, code vector $e_{sl}$ (l=1 to m) is outputted from a stochastic excitation codebook 108. Similarly, excitation gains $B_k$ and $Y_k$ (k=1 to r) are outputted from a VQ gain codebook 110.

A code vector conversion circuit 109, which has an impulse response of a filter transfer function H(Z) represented by the following formula (3), performs convolutional computation with stochastic excitation code vector $e_{sl}$ from stochastic excitation codebook 108, and transmits a converted stochastic excitation code vector $e_{scl}$.

$$H(Z)=\left(1-\sum_{j=1}^{P}0.4^{j}aqj^{-j}\right)/\left(1-\sum_{j=1}^{P}0.9^{j}aqj^{-j}\right) \tag{3}$$

wherein $a_{qj}$ represents an output of LPC inverse quantization circuit 104 and p represents the vocal tract analysis order.

The adaptive excitation code vector $e_{ai}$ is multiplied by the gain $B_k$ by means of a multiplier 113 to produce a vector $e_{aik}$ and, on the other hand, the converted stochastic excitation code vector $e_{scl}$ is multiplied by the gain $Y_k$ by means of a multiplier 114 to produce a vector $e_{sclk}$.

An adder 115 adds the components of vector $e_{aik}$ and vector $e_{sclk}$ and produces an excitation code vector e.

The synthesis filter 105 calculates synthetic speech vector $S_w$ corresponding to the excitation codevector e and transmits it to a subtracter 116.

The subtracter 116 performs the subtraction between the synthesized speech vector $S_w$ and the input speech vector S, and the obtained error vector $e_r$ between Sw and S is transmitted to a perceptual weighting filter 111.

The perceptual weighting filter 111 transmits a perceptual weighting error vector $e_w$ corresponding to the error vector $e_r$ to a perceptual weighting error calculation circuit 112.

The perceptual weighting error calculation circuit 112 calculates a mean square value of each component of the perceptual weighting error vector $e_w$ and determines the excitation code vector (i.e., combination of i, l and k) to minimize the mean square error power of $e_w$ for the input speech vector at the present time. Indexes $I_a$, $I_s$ and $I_g$ of each codebook at this moment are transmitted to each of the adaptive excitation codebook 107, stochastic excitation codebook 108, VQ gain codebook 110 and multiplex circuit 106.

The adaptive excitation codebook 107 outputs an optimum adaptive excitation code vector $e_{ao}$ assigned by index $I_a$, the stochastic excitation codebook 108 outputs an optimum stochastic excitation code vector $e_{s0}$ assigned by index $I_s$, and the VQ gain codebook 110 transmits optimum VQ gains $\beta_0$ and $\gamma_0$ assigned by index $I_g$. Code vector conversion circuit 109 converts the stochastic code vector $e_{s0}$ which has been transmitted from the stochastic excitation codebook 108 in accordance with the index $I_s$ into an optimum converted stochastic excitation code vector $e_{sc0}$ and then outputs it to the multiplier 114.

An optimum excitation code vector $e_{opt}$ composed of the code vector $e_{ao}$ and $e_{sco}$ and the optimum VC gains $\beta_0$ and $\gamma_0$ is transmitted to the adaptive excitation codebook 107 and updates the content of the adaptive excitation codebook 107.

The multiplex circuit 106 multiplexes $I_c$, $I_a$, $I_s$, and $I_g$, as a total code C, and transmits it to the receiver through an output terminal 117.

Figure 2:
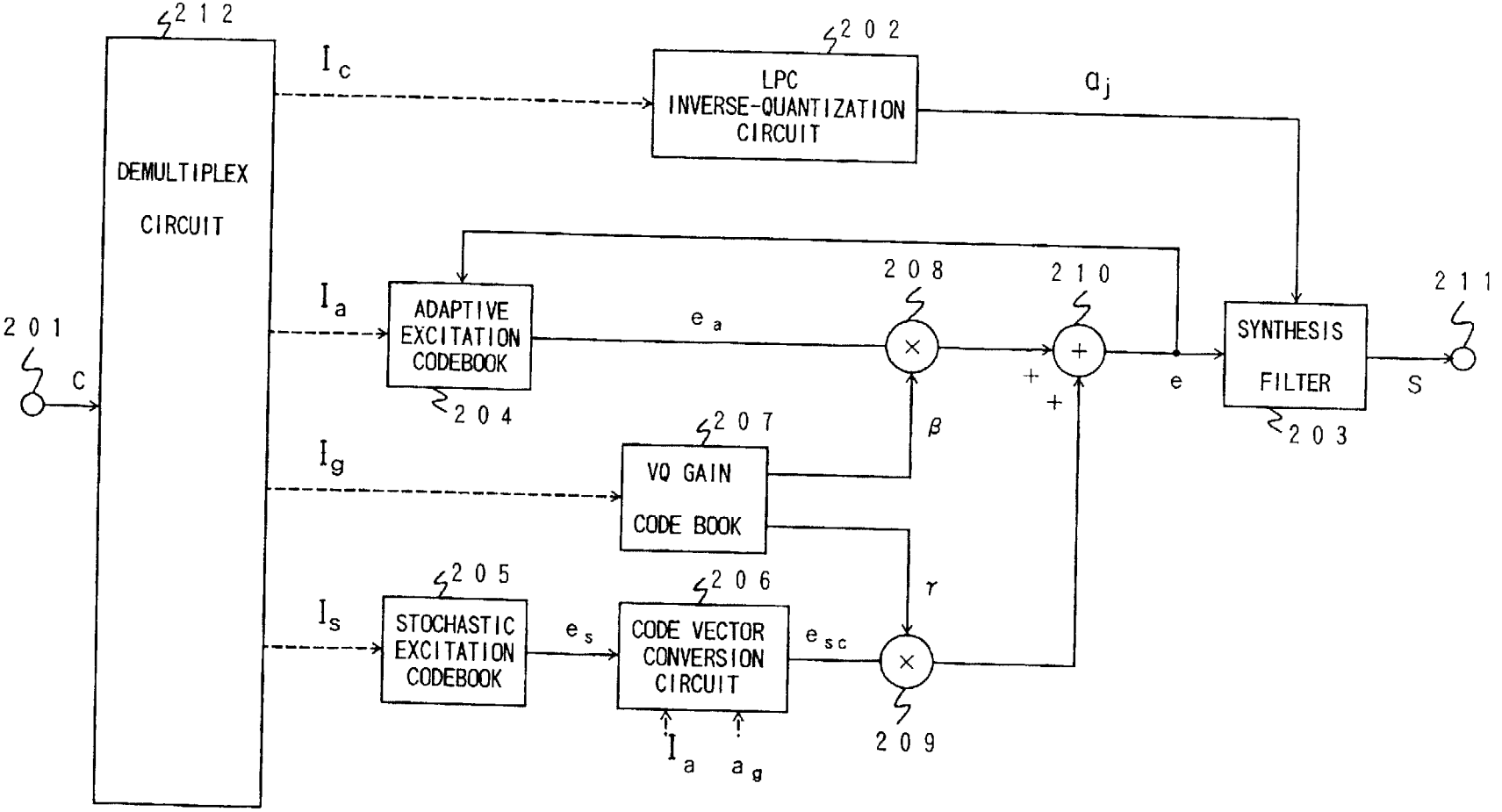
FIG. 2 is a block diagram of a code excitation linear predictive decoder in correspondence with the code excitation linear predictive encoder shown in FIG. 1. The decoder shown in FIG. 2 differs from the prior art only in that a code vector conversion circuit (206) has been added.

FIG. 2 is a block diagram of a code excitation linear predictive decoder corresponding to the code excitation linear predictive encoder of FIG. 1.

In FIG. 2 the total code C from an input terminal 201 is separated by a demultiplex circuit 212 into LPC code $I_c$, adaptive excitation code index $I_a$, stochastic excitation code index $I_s$, and VQ gain code index $I_g$ and they are transmitted, respectively, to LPC inverse quantization circuit 202, adaptive excitation codebook 204, stochastic excitation codebook 205 and VQ gain codebook 207.

The LPC inverse quantization circuit 202 converts the LPC code $I_c$ into vocal tract predictive parameter $a_j$ and transmits to a synthesis filter 203. The adaptive excitation codebook 204 outputs adaptive excitation code vector $e_a$ assigned by the index $I_a$, the stochastic excitation codebook 205 outputs a stochastic excitation code vector $e_s$ assigned by the index $I_s$, and VQ gain codebook 207 outputs excitation gains $\beta$ and $\gamma$, assigned by index $I_g$.

A codevector conversion circuit 206 converts the vector $e_s$ into a vector $e_{sc}$ and outputs it similarly to the output of code vector conversion circuit 109 of the aforementioned code excitation linear predictive coding apparatus (encoder) of FIG. 1.

The adaptive excitation code vector $e_a$ is multiplied by the gain $\beta$ by means of multiplier 208, and the vector $e_{sc}$ is multiplied by gain $\gamma$ by the means of multiplier 209. These multiplied vector components are added by adder 210, and final excitation code vector e for synthesis filter 203 is obtained.

Synthesis filter 203 calculates a synthesized speech vector S corresponding to the excitation code vector e and outputs it to an output terminal 211 At the same time, the content of the adaptive excitation codebook 204 is updated by vector e.

The code excitation linear predictive encoder according to a second embodiment of the invention will be explained by again referring to FIG. 1.

This code excitation linear predictive encoder according to a second embodiment has a similar construction to that of the first embodiment except for the operation of the codevector conversion circuit 109 and, therefore, the operational mode of the code vector conversion circuit 109 will be explained.

The code vector conversion circuit 109, according to the second embodiment has an impulse response of a filter transfer function H(Z) shown by the following formula (4) and performs convolutional computation with the vector $e_{sl}$ and results in the vector $e_{scl}$.

$$H(Z)=1/(1-\epsilon Z^{-L}) \tag{4}$$

Where $\epsilon$ is $\leqq 1.0$, and L is a pitchlag obtained from the index of the adaptive excitation code.

Incidentally, in a shift-type adaptive excitation codebook, the index of the adaptive excitation code corresponds with the pitch lag index as tabulated below.

| Adaptive code index | 0 | 1 | 2 . . . | i |
|---|---|---|---|---|
| | ↓ | ↓ | ↓ | ↓ |
| Pitch lag | 20 | 21 | 22 . . . | 20 + i |

The convolutional processing of the aforementioned code excitation linear predictive coding apparatus (encoder) is represented by the following formula (5), provided that the $e_{sl}$ is an output stochastic excitation code vector of the stochastic excitation codebook, $e_{scl}$ is a stochastic excitation code vector after the conversion, and h is an impulse response of the conversion circuit.

$$e_{scl}=e_{sl}X\ h \tag{5}$$

wherein:

$e_{scl}=[x_0, X_1, \ldots, X_{n-1}]$, $e_{sl}=[Y_0, Y_1, \ldots, Y_{n-1}]$, $h=[h_0, h_1, \ldots, h_{n-1}]$, where the bracket [] is a column vector.

x, y and h are elements, and n is subframe length (or frame length).

A transfer function composed of a vocal tract parameter, or a transfer function composed of the pitch lag, can be used for the impulse response of code conversion circuit; alternatively, the two transfer functions can be cascaded to form the impulse response.

Figure 3:
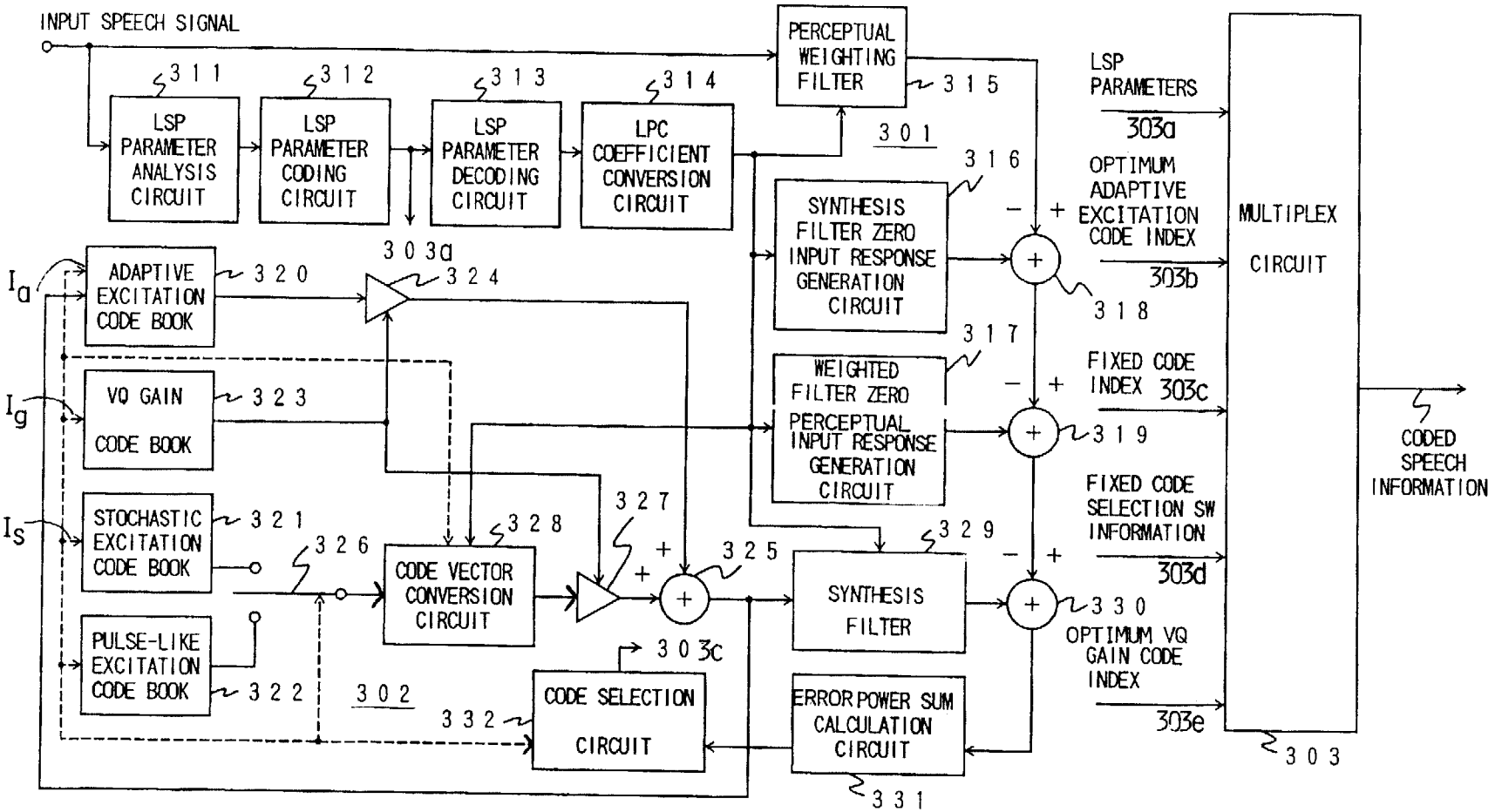
FIG. 3 is a block diagram of a code excitation linear predictive encoder (coding apparatus) according to a third embodiment of the invention, the solid lines between components in FIGS. 1–3 representing the flow of signals in the encoding and decoding apparatus and the dashed lines representing the flow of information comprising the indices of the code books. The encoder of FIG. 3 differs from the prior art only in that a pulse-like excitation code book (322), a fixed codebook selection switch (326) and a code vector conversion circuit (328) have been added.

FIG. 3 is a block diagram of a code excitation linear predictive encoder according to a third embodiment of the invention. In FIG. 3 this code excitation linear predictive encoder is primarily composed of an input speech process portion 301, optimum synthesized speech search portion 302 and multiplex circuit 303.

The input speech process portion 301 has LSP parameter analysis circuit 311, LSP parameter coding circuit 312, LSP parameter decoding circuit 313, LPC coefficient conversion circuit 314, perceptual weighting filter 315, synthesis filter zero input response generation circuit 316, perceptual weighted filter zero input response generation circuit 317, and subtracters 318 and 319. When an input vector is applied, a speech parameter which is to be transmitted to the decoder is obtained and a target speech vector for a synthesized speech vector is formed by local reproduction.

In the code excitation linear predictive encoder, digitalized discrete input speech vector series are stored for the time which corresponds to an analysis frame length for obtaining a vocal tract parameter, and this analysis frame length is separated into several subframes and processed by input speech processing portion 301.

The input speech vector is given to the LSP parameter analysis circuit 311, analyzed by the LSP analysis circuit 311, and converted to an LSP parameter as a vocal tract parameter. This LSP parameter is coded (for example, to be vector quantized) by LSP parameter coding circuit 312, given to the multiplex circuit 303 as data 303*a*, corresponding to LSP parameters $I_c$ and transmitted to the code excitation linear decoder. The coded LSP parameter is decoded (vector quantized) by LSP parameter decoding circuit 313 and converted to LPC by the LPC conversion circuit 314. The thus converted LPC is used as a tap coefficient for perceptual weighting filter 315, synthesis filter zero input response generation circuit 316, perceptual weighted filter zero input generation circuit 317 and a synthesis filter 329 which will be described presently, and given also to a code vector conversion circuit 328. The quantized LSP parameter is converted into LPC.

Next, an operation for forming a target speech vector, relative to a synthesized speech vector which is locally reproduced from the input speech vector, will be explained.

The input speech vector described above is given to the perceptual weighting filter 315 and after the weighting processing in consideration of human perceptual characteristics, the input speech vector is given to a subtracter 318 to be subtracted. Further, a zero input response vector in relation to a synthesis filter 329, is given for input to subtracter 318. Thus, a speech vector, from which an influence of the synthesis filter 329 in the immediately before analysis frame is excluded, is given to subtracter 319 from subtractor 318. Further, a zero input response vector in relation to the perceptual weighting filter 315, is given for input to subtracter 319. Thus, a speech vector, from which an influence of the weighted filter 315 in the immediately before analysis frame is obtained, is given to subtracter 330 from subtractor 319.

The optimum synthesized speech search portion 302 serves to search an excitation source parameter in which the synthesis speech vector in the local reproduction is most similar to the target speech vector, and is composed of adaptive excitation codebook 320, stochastic excitation codebook 321, pulse-like excitation codebook 322, VQ gain codebook 323, VQ gain controllers 324 and 327, adder 325, fixed codebook selection switch 326, code vector conversion circuit 328, synthesis filter 329, subtracter 330, error power sum calculation circuit 331 and code selection circuit 332.

Each of the adaptive excitation codebook 320, stochastic excitation codebook 321 and pulse-like excitation codebook 322 stores an adaptive excitation code vector, which is a waveform code in relation to an excitation signal, stochastic excitation, code vector and pulse-like excitation, code vector, respectively, and VQ gain codebook 323 stores a VQ gain code which is related to an adaptive excitation code vector and fixed code vector (which generally represents stochastic excitation code vector and pulse-like excitation code vector).

The adaptive excitation code vector contributes to the voiced speech signal having stochastic periodicity, while the stochastic excitation code vector contributes to the unvoiced speech signal having stochastically less periodicity. The adaptive excitation code vector the adaptive excitation codebook 320 is adaptively updated as described presently.

The pulse-like excitation code vector is a waveform excitation code vector consisting of unit impulse and is considered to contribute to the steady portion of the voiced speech signal having a strong periodicity.

The VQ gain code is vector-quantized, for example, and one component of the vector relates to VQ gain for the adaptive excitation code vector and the other component relates to VQ gain for the fixed code vector.

The pulse-like excitation code vector is a periodic simple signal which can be generated by means of a pulse signal generating circuit, but it can preferably be generated by coding and reading out from the codebook 322 as in this code excitation linear predictive encoder, the reason for which will be explained presently. Namely, it is easy to synchronize the excitation vector with an output from the adaptive excitation codebook 320. The same processing for selecting the stochastic excitation codebook can be a pulse-like excitation code vector search by constituting the excitation code vector to have the same codebook construction as the codebook 321.

By utilizing the various codebooks to obtain an optimum code, the locally synthesized speech vector becomes the most similar to the target speech vector, and its indices are given to the multiplex circuit 303 and are transmitted to the code excitation linear predictive decoder portion.

In case of the search of an optimum code including a selection of the stochastic excitation code vector or the pulse-like excitation code vector as described above, the searching is carried out with respect to the adaptive excitation code, stochastic excitation code, pulse-like excitation code and VQ gain code, in turn, in this code excitation linear predictive encoder.

In case of searching an optimum adaptive excitation code vector, an output from the stochastic excitation codebook 321 and the pulse-like excitation codebook 322 are assigned to be zero (0), and the VQ gain controller 324 multiplies a suitable value of a VQ coefficient ("1", for example). In this state, the adaptive excitation codebook 320 outputs all of the stored adaptive excitation code vector sequentially or in parallel, and gives it as an excitation code vector to the synthesis filter 329 through the VQ gain controller 324 and the adder 325. The synthesis filter 329 carries out a convolutional computing relative to the excitation code vector, by utilizing, as a tap coefficient, the LPC which is given from the LPC conversion circuit 314, and synthesized speech vectors, which are synthesized only by the content of the adaptive excitation code vector as the excitation source signal, are obtained with respect to all the adaptive excitation code vector.

The subtracter 330 obtains, with respect to all of the adaptive excitation code vector, an error vector between the synthesized speech vector on which only the content of the adaptive..excitation code vector is effected and the target speech vector, and then gives it to the error power sum calculation circuit 331. The error power sum calculation circuit 331 obtains a square sum (error power sum) of the error vector, with respect to all the adaptive code vector, and gives it to a code selection circuit 332. The code selection circuit 332 determines the adaptive excitation code vector to minimize the error power sum.

Next, an optimum stochastic excitation code vector searching is carried out and in the searching of this, a fixed codebook selection switch 326 is driven to the side of the stochastic excitation codebook 321, the output from adaptive excitation codebook 320 is set to zero (0) or to the previously obtained optimum adaptive excitation code vector. In this state, the stochastic excitation codebook 321 outputs sequentially or in parallel, all the stored stochastic excitation code vectors,and inputs them into the code vector conversion circuit 328 through the fixed codebook selection switch 326.

The code vector conversion circuit 328 proceeds with the conversion of the frequency characteristics of the inputted stochastic excitation code vector so that it is moved to close the frequency characteristics of an input speech vector in correspondence with the time-length of the stochastic excitation code vector. As described above, all the stochastic exited code vector with its frequency characteristics being conversion-processed is given, as an excitation code vector, to the synthesis filter 329. Thereafter, it is processed similarly to the searching of the optimum adaptive excitation code vector, and the code selection circuit 332 determines an optimum stochastic excitation code vector.

After the searching of the optimum stochastic excitation code vector is finished as described above, a searching of an optimum pulse-like excitation code vector is carried out. At this searching, the fixed codebook selection switch 326 is driven to the side of the pulse-like excitation codebook 322 the output from adaptive excitation codebook 320 is set to zero (0) or to the previously obtained optimum adaptive excitation code vector. In this state, the pulse-like excitation codebook 322 outputs sequentially or in parallel, all the stored pulse-like excitation code vectors. Processings thereafter is substantially similar to that of the moment when an optimum stochastic excitation code vector is searched and, accordingly, a more detailed explanation is not necessary.

As described above, when the optimum pulse-like excitation code vector is determined, the code selection circuit 332 compares the error power sum of the selected code vector in the stochastic excitation code vector search with the error power sum of the selected code vector in the pulse-like excitation code vector search to obtain smallest error power sum, and determine a fixed code to be transmitted to the code excitation linear predictive decoder.

Thereafter, a searching of an optimum VQ gain code is carried out. At the searching of this VQ gain code, an optimum (selected) adaptive excitation code vector is transmitted from the adaptive excitation codebook 320, and the fixed codebook selection switch 326 is switched to either the selected stochastic excitation codebook 321 or pulse-like excitation codebook 322, and an optimum (selected) fixed code vector is outputted from the selected fixed codebook 321 or 322. VQ gain codebook 323 is composed of VQ gain for an adaptive excitation code vector and VQ gain for the fixed code vector. The VQ gain for the adaptive excitation code vector is given to the VQ gain controller 324 and the VQ gain for the fixed code vector is given to the VQ gain controller 327. Thus, both the VQ gain-controlled optimum adaptive excitation code vector and the optimum fixed code vector, which have been processed with respect to a frequency characteristic operation and VQ gain control, are added by the adder 325 and then given to synthesis filter 329 as an excitation code vector. This processing is carried out sequentially or in parallel, relative to all the VQ gain codes in the VQ gain codebook 323.

After an optimum adaptive excitation code 303*b*, optimum fixed code 303 *c* and optimum VQ gain code 303*e* are selected, the code selection circuit 332 gives the indexes, $I_s$, $I_a$ and $I_g$ respectively of these codes to the multiplex circuit 303, and, fixed codebook selection switching information 303*d*, which provides information as to which one of the stochastic excitation code vector and the pulse-like excitation code vector is actually selected, is given to the multiplex circuit 303. The multiplex circuit 303 multiplexes the indexes with the LSP parameters given from the LSP parameter coding circuit 312 and transmits the coded speech information to the code excitation linear predictive decoder. Incidentally, in the case of utilizing a vector quantization for a VQ gain coding method, the transmitted index is a vector number.

The coding processings described above is repeated with respect to each subframe, and the coded speech information is transmitted in turn to the code excitation linear predictive decoder.

Figure 5:
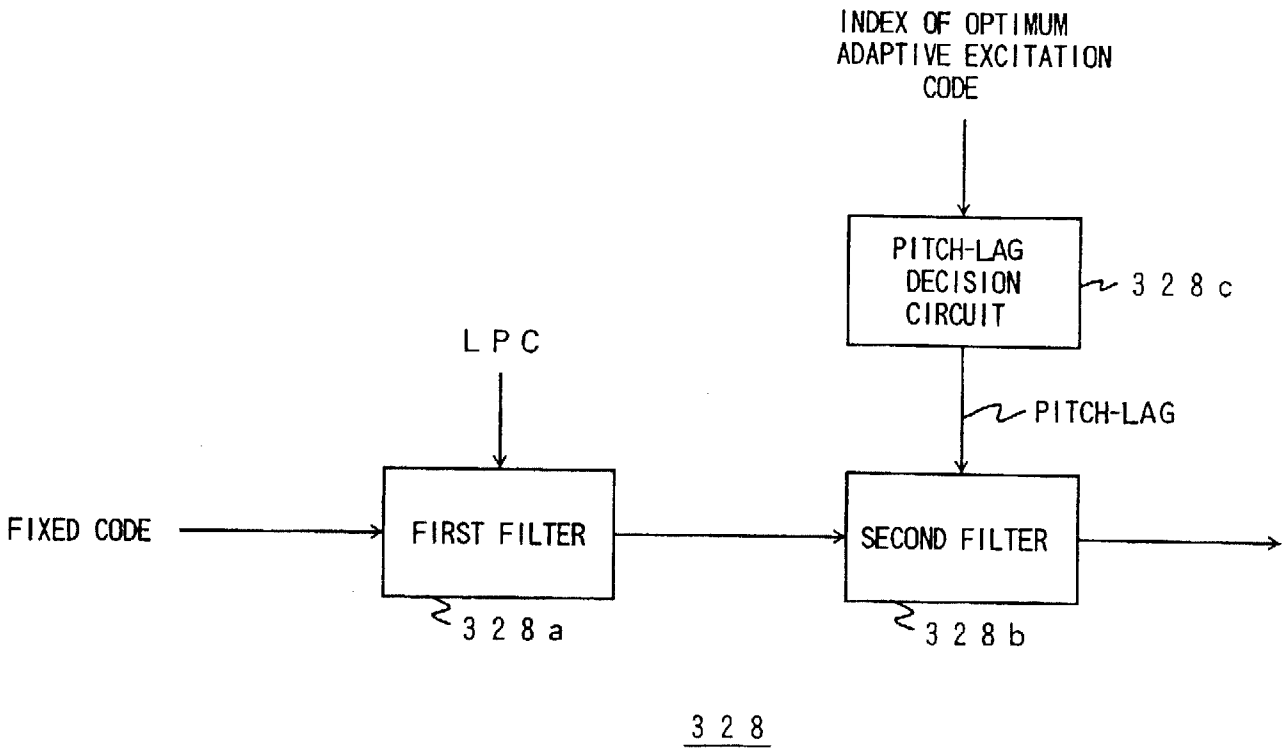
FIG. 5 is a detailed block diagram of the code vector conversion circuits shown in FIGS. 3 and 4.

FIG. 5 shows in detail the specific structure of the code vector conversion circuit 328. In FIG 5, the code vector conversion circuit 328 has two cascaded filters 328*a* and 328*b*, and a pitch lag decision circuit 328*c*.

The fixed code vector is given to a first filter 328*a*. An impulse response Hi(Z) of the first filter 328*a* is set as shown by formula (6), by which the frequency conversion processing is carried out relative to the fixed vector.

$$H1(Z)=(1-\Sigma A^{j}ajZ^{-j}) \tag{6}$$

wherein aj (j is 1 to p) is a tap coefficient relative to synthesis filter 329 which is supplied from the LPC conversion circuit 314, and p is a vocal tract analysis order. Further, A and B are constants which are determined in the ranges of $0<A\leqq 1$, and $0<B\leqq 1$.

The code vector which was processed in its frequency characteristics by the first filter 328*a* is transmitted to the second filter 328*b*. The pitch lag decision circuit 328*c* obtains a pitch lag L from the index of the optimum adaptive excitation code relative to the adaptive excitation codebook 320 and then gives the pitch lag L to the second filter 328*b*. An impulse response H2(Z) of the second filter 328*b* is determined as shown by formula (7), by which a frequency conversion is carried out relative to the inputted fixed code vector.

$$H2(Z)=1/(1\epsilon Z^{-L}) \tag{7}$$

wherein $\epsilon$ is a constant determined in the range of $0<\epsilon\leqq 1$. An output of the second filter 328*b* is given to VQ gain controller 327 shown in FIG. 3.

By the code vector conversion circuit 328 as described above, the frequency characteristics of inputted fixed code vector can be made closer to the frequency characteristics of the input speech vector, in accordance with the time length of the fixed code vector.

Accordingly, the code excited linear predictive coding apparatus (encoder) can provide a high quality regenerated speech signal.

Next, a code excitation linear predictive decoder in correspondence with the code excitation linear predictive coding apparatus (encoder) shown in FIG. 3 will be described with reference to the accompanying drawing.

Figure 4:
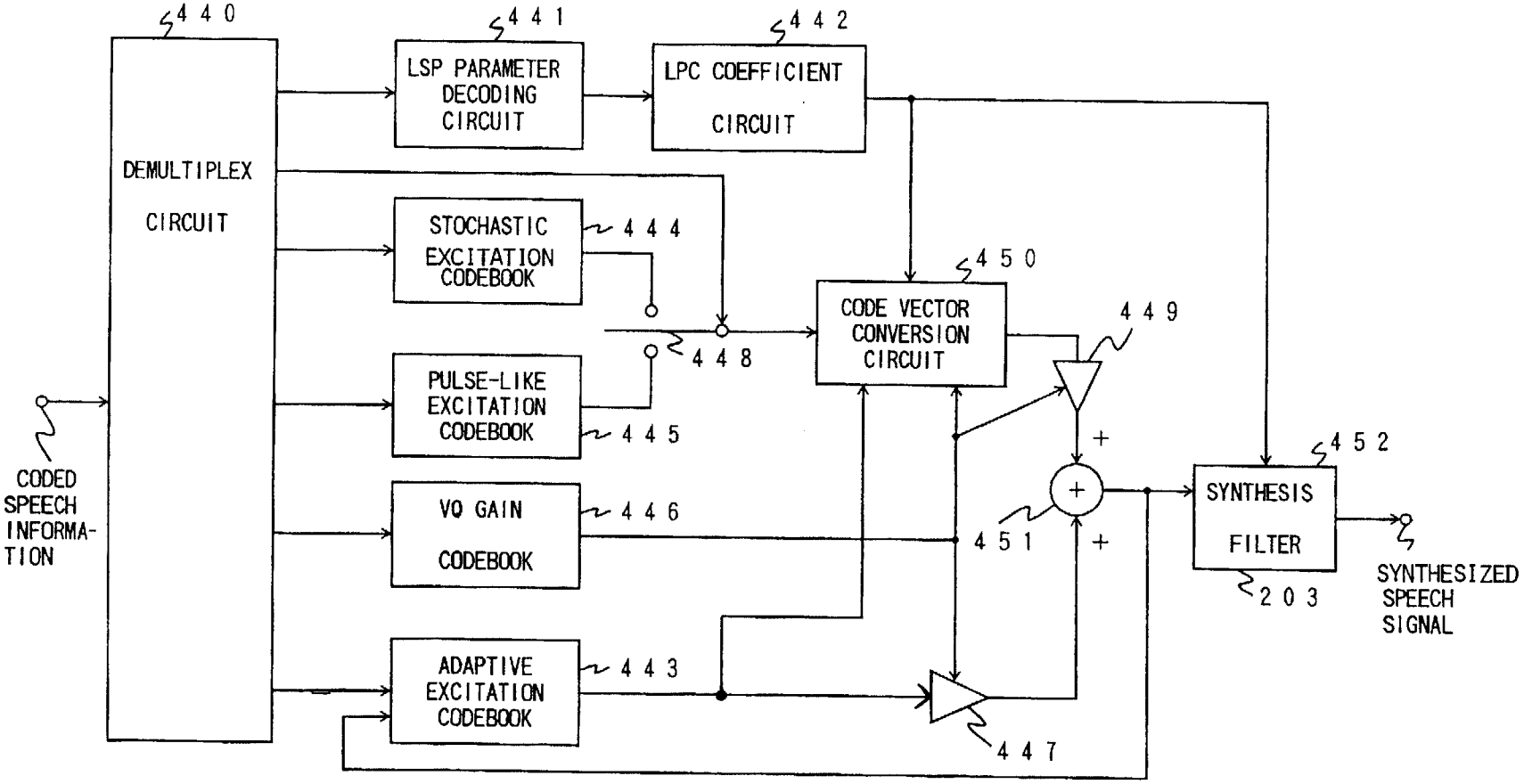
FIG. 4 is a block diagram of a code excitation linear predictive decoder in correspondence with the code excitation linear predictive encoder shown in FIG. 3. The decoder of FIG. 4 differs from the prior art only in that a pulse-like excitation codebook (445), a fixed codebook selection switch (448) and a code vector conversion circuit (450) have been added.

FIG. 4 is a block diagram of a code excitation linear predictive decoder which corresponds to the code excitation linear predictive coding apparatus (encoder) shown in FIG. 3. In FIG. 4, the code excitation linear predictive decoder has demultiplex circuit 440, LSP parameter decoding circuit 441, LPC coefficient conversion circuit 442, adaptive excitation codebook 443, stochastic excitation codebook 444, pulse-like excitation codebook 445, VQ gain codebook 446, VQ gain controller 447, VQ gain controller 449, fixed codebook selection switch 448, code vector conversion circuit 450, adder 451 and synthesis filter 452.

The coded speech information given from the code excitation linear predictive encoder is input to the demultiplex circuit 440. The demultiplex circuit 440 separates the coded speech information into LSP parameter code, index of the optimum adaptive excitation code, index of the optimum fixed code, index of the optimum VQ gain codebook and fixed code selection switch information.

Then, LSP parameter code is given to the LSP parameter decoding circuit 441 and the index of the optimum adaptive excitation code is given to the adaptive excitation codebook 443. Further, the index of optimum VQ gain code is given to the VQ gain codebook 446 and the fixed codebook selection switch information is given to the fixed codebook selection switch 448.

The index of the optimum fixed code is given to pulse-like excitation codebook 445 or a stochastic excitation codebook 444 which are determined by the fixed code selection switching information. The adaptive excitation codebook 443 outputs an adaptive excitation code vector which is determined by a given index, and this adaptive excitation code vector is VQ gain-controlled through VQ gain controller 447 and given to an adder 451. Further, the adaptive excitation codebook 443 gives an adaptive excitation code vector to a code vector conversion circuit 450.

The stochastic excitation codebook 444 or pulse-like excitation codebook 445 gives a stochastic excitation code vector or pulse-like excitation code vector, which corresponds to the given index, to a code vector conversion circuit 450 through a fixed codebook selection switch 448.

The code vector conversion circuit 450 operates so that the frequency characteristics become closer to the frequency characteristics of the input speech vector in accordance with the index of the LPC and adaptive excitation code vector. A specific structure of the code vector conversion circuit 450 is the same as that of the structure shown in FIG. 5. Thus, the frequency-processed fixed code vector is VQ gain-controlled by a VQ gain controller 449 and then given to an adder 451.

The adder 451 adds the given adaptive excitation code vector and the fixed code vector together, and the added vector is assigned to be an excitation code vector, which is then given to the synthesis filter 452. The synthesis filter 452 outputs a synthesized speech vector.

The code excitation linear predictive decoder conducts the above-described processes every time a decoded speech vector is given or, in other words, for each subframe.

Important features of the present invention are that the LSP parameter is used and transmitted as a vocal tract parameter; a pulse-like excitation codebook is provided for giving an excitation source parameter; and a frequency characteristic of the fixed code vector is controlled. These features can be independently provided to each of the coding apparatus and decoding apparatus without failure of the advantages and effects thereof.

In addition, the coding apparatus and decoding apparatus described above are related primarily to the forward-type code excitation linear predictive encoder and decoder, respectively, but the present invention is not limited thereto but applicable to a backward-type code excitation linear predictive encoder and decoder, respectively.

The above-described encoder and decoder were intentionally designed under the technological basis for seeking to solve the problems induced from the low rate coding of 4-bit/s or less. However, more favorable sound reproduction can be realized if they are adapted to encoders and decoders having coding at a higher rate. If the higher coding rate is allowable, both of the stochastic excitation codebook and pulse-like excitation codebook can cooperate effectively rather than selectively operating either the stochastic excitation codebook or the pulse-like excitation codebook.

INDUSTRIAL APPLICABILITY

According to the present invention, it is considered that the frequency characteristic of an actual excitation code vector is relatively close to that of an input speech vector and, in order to make the frequency of the excitation code vector closer to a frequency of the input speech vector, the stochastic excitation code vector is convolutionally computed utilizing a specific impulse response. Thereafter, an adaptive excitation code vector is added to produce an excitation code vector and, therefore, an excitation code vector which is well adapted to an input speech vector by a small number of vector vectors can be obtained and, at the same time, the quantization error can be masked with a conversion operation of an excitation code vector, thereby improving reproduction quality.

Further, in addition to the adaptive excitation codebook and stochastic excitation codebook, pulse-like excitation codebook is disposed which stores therein a pulse-like excitation code vector composed a unit impulse and, accordingly, rapid tracking of a speech signal having periodicity can be realized, and a clear pulse-like excitation code vector can be formed at a steady portion of the speech signal.

Besides, since the pulse-like excitation code vector and the stochastic excitation code vector are switched over, the apparatus of the present invention can be adapted to low rate coding, and a favorably reproduced speech can be realized at the time, for example, of a transitional period of the speech in which there are random signals and pulse-like signals together.

In addition, according to the code excitation linear coding apparatus and decoding apparatus, an excitation code vector is selected and used from either a stochastic excitation codebook or a pulse-like excitation codebook and, therefore, a favorable reproduction of speech sound can be realized with the condition that the number of coded bits of the excitation source parameter is small.

Further, the vocal tract parameter for sound synthesization is used as an LSP parameter which gives less distortion to the vocal tract vector than LPC when it is coded with a smaller number of code bits and, therefore, reproduction quality at a lower coding rate can be improved from a vocal tract parameter viewpoint.

What is claimed is:

1. A code excitation linear predictive coding apparatus comprising:

excitation codebook means for selectively outputting an excitation code vector as an excitation source information of a speech signal; and code vector conversion circuit means for converting the excitation code vector selectively output from the excitation codebook means into a frequency characteristic determined at the time of output of said excitation code vector.

2. A coding apparatus according to claim 1, wherein the code vector conversion circuit means generates an impulse response of a transfer function which is determined in accordance with a vocal tract parameter of an input speech signal, and convolves the excitation code vector with the impulse response.

3. A coding apparatus according to claim 2, wherein the impulse response of the transfer function which is determined in accordance with the vocal tract parameter is represented by:

$$H(Z)=(1-\Sigma A^{j}ajZ^{-j})/(1\Sigma B^{j}ajZ^{-j})$$

where aj (j is 1 to p) is a linear predictive coefficient; p is a vocal tract analysis order; and A and B are in the ranges:0<A<1 and 0<B1.

4. A coding apparatus according to claim 1, wherein the code vector conversion circuit means generates an impulse response of a transfer function which is determined in accordance with an excited pitch lag, and convolves the excitation code vector with the impulse response.

5. A coding apparatus according to claim 4, wherein the impulse response of the transfer function which is determined in accordance with the excited pitch lag is represented by:

$$H(Z)=1/(1-\epsilon Z^{-L})$$

where $\epsilon$ is a constant satisfying a range of $0<\epsilon\leqq 1$; and L is a pitch lag signal.

6. A coding apparatus according to claim 1, wherein the code vector conversion circuit means convolves the excitation code vector with the impulse response of the transfer function which is determined in accordance with transfer functions represented by:

$$H(Z)=(1-\Sigma A^{j}ajZ^{-j})/(1-\Sigma B^{j}ajZ^{-j})$$

and $$H(Z)=1/(1-\epsilon Z^{-L})$$

where aj (j is 1 to p) is a linear predictive coefficient; p is a vocal tract analysis order; A, B and $\epsilon$ are in the ranges: $0<A<1$, $0<B<1$ and $0<\epsilon\leqq 1$; and L is a pitch lag signal.

7. A code excitation linear predictive decoding apparatus comprising:

excitation codebook means for selectively outputting an excitation code vector as an excitation source information of a speech signal; and code vector conversion circuit means for converting the excitation code vector selectively output from the excitation codebook into a frequency characteristic determined at the time of output of said excitation code vector.

8. A decoding apparatus according to claim 7, wherein the code vector conversion circuit means generates an impulse response of a transfer function which is determined in accordance with a vocal tract parameter of an input speech signal, and convolves the excitation code vector with the impulse response.

9. A decoding apparatus according to claim 8, wherein the impulse response of the transfer function which is determined in accordance with the vocal tract parameter is represented by:

$$H(Z)=(1-\epsilon A^{j}ajZ^{-j})/(1-\epsilon B^{j}ajZ^{-j})$$

where aj (j is 1 to p) is a linear predictive coefficient; p is a vocal tract analysis order; and A and B are in the ranges: $0<A<1$ and $0<B1$.

10. A decoding apparatus according to claim 7, wherein the code vector conversion circuit means generates an impulse response of a transfer function which is determined in accordance with an excited pitch lag, and convolves the excitation code vector with the impulse response.

11. A coding apparatus according to claim 10, wherein the impulse response of the transfer function which is determined in accordance with the excited pitch lag is represented by:

$$H(Z)=1/(1\epsilon Z^{31\ L})$$

where $\epsilon$ is a constant satisfying a range of $0<\epsilon\leqq 1$; and L is a pitch lag signal.

12. A decoding apparatus according to claim 7, wherein the code vector conversion circuit means convolves the excitation code vector with the impulse response of the transfer function which is determined in accordance with transfer functions represented by:

$$H(Z)=(1-\epsilon A^{j}ajZ^{-j})/(1-\epsilon B^{j}ajZ^{-j})$$

and $$H(Z)=1/(1-\epsilon Z^{-L})$$

where aj(j is 1 to p) is a linear predictive coefficient; p is a vocal tract analysis order; A, B and $\epsilon$ are in the ranges: $0<A<1$, $0<B<1$ and $0<\epsilon\leqq 1$; and L is a pitch lag signal.

13. A code excitation linear predictive coding apparatus comprising:

excitation codebook means for outputting an excitation code vector as an excitation source information of a speech signal; and pulse-like excitation codebook means for storing a pulse-like excitation code vector composed of an unit impulse.

14. A code excitation linear predictive coding apparatus according to claim 13, further comprising means for generating a pulse-like excitation code vector from the pulse-like excitation codebook means, and means for transmitting information indicative of what pulse-like excitation code vector is selected to a code excitation linear predictive decoding apparatus.

15. A code excitation linear predictive coding or decoding apparatus according to claim 14, further comprising:

code vector conversion circuit means for converting the pulse-like excitation code vector transmitted from the pulse-like excitation codebook into a frequency characteristic determined at the time of output of the pulse-like excitation code vector.

16. A code excitation linear predictive coding apparatus according to claim 13, further comprising means for generating a vocal tract parameter, and transmitting the vocal tract parameter in the form of a linear spectrum pair parameter to a code excitation linear predictive decoding apparatus.

17. A code excitation linear predictive decoding apparatus comprising:

excitation codebook means for outputting an excitation code vector as an excitation source information of a speech signal; and pulse-like excitation codebook means for storing a pulse-like excitation code vector composed of an unit impulse.

18. A code excitation linear predictive decoding apparatus according to claim 17, further comprising means for selecting the pulse-like excitation code vector in the pulse-like excitation codebook in accordance with selected information transmitted from a corresponding code excitation linear predictive coding apparatus.

19. A code excitation linear predictive decoding apparatus according to claim 17, further comprising means for receiving a vocal tract parameter in the form of a linear spectrum pair parameter used for vocal tract reproduction from a corresponding code excitation linear predictive coding apparatus.

20. A code excitation linear predictive coding method comprising the steps of:

selectively outputting an excitation code vector from an excitation codebook as an excitation source information of a speech signal;

converting the excitation code vector into a converted code vector having a frequency characteristic; and multiplying the converted code vector by a gain output from a gain codebook.

21. A code excitation linear predictive coding method according to claim 20, wherein the converting step comprises the steps of:

generating an impulse response of a transfer function which is determined in accordance with a vocal tract parameter output from an input speech vector; and convolving the excitation code signal with the impulse response in order to obtain the converted code vector.

22. A code excitation linear predictive coding method according to claim 20, wherein the converting step comprises the steps of:

generating an impulse response of a transfer function which is determined in accordance with an excited pitch lag obtained from indexes of an adaptive excitation code; and convolving the excitation code signal with the impulse response in order to obtain the converted code vector.

* * * * *